US008310140B2

(12) United States Patent
Uchida

(10) Patent No.: US 8,310,140 B2
(45) Date of Patent: Nov. 13, 2012

(54) AIRTIGHT CONTAINER AND IMAGE DISPLAYING APPARATUS USING THE SAME

(75) Inventor: Takeshi Uchida, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 163 days.

(21) Appl. No.: 12/834,086

(22) Filed: Jul. 12, 2010

(65) Prior Publication Data

US 2011/0025931 A1 Feb. 3, 2011

(30) Foreign Application Priority Data

Jul. 28, 2009 (JP) ..... 2009-175388

(51) Int. Cl.
*H01J 1/88* (2006.01)

(52) U.S. Cl. ..... 313/292

(58) Field of Classification Search ..... 313/292, 313/512

See application file for complete search history.

(56) References Cited

U.S. PATENT DOCUMENTS

| | | | | |
|---|---|---|---|---|
| 7,719,191 | B2 * | 5/2010 | Nishimura et al. | 313/582 |
| 2005/0009434 | A1 | 1/2005 | Kanda et al. | |
| 2008/0284334 | A1 * | 11/2008 | Oh et al. | 313/586 |

FOREIGN PATENT DOCUMENTS

| | | | |
|---|---|---|---|
| EP | 1 780 757 | A2 | 5/2007 |
| EP | 1 848 021 | A1 | 10/2007 |
| JP | 10-254375 | A | 9/1998 |
| JP | 2002-358915 | A | 12/2002 |

OTHER PUBLICATIONS

Machine Translation of Yamanobe JP10254375 (A).*
European Search Report dated Jun. 10, 2011, in related corresponding European Appln. No. 10170431.0.

* cited by examiner

*Primary Examiner* — Anh Mai
*Assistant Examiner* — Andrew Coughlin
(74) *Attorney, Agent, or Firm* — Fitzpatrick, Cella, Harper & Scinto

(57) ABSTRACT

An airtight container includes a front substrate, a rear substrate opposite to the front substrate, a plurality of spacers arranged between the front substrate and the rear substrate with the spacers having a predetermined interval therebetween, and a frame provided between the front substrate and the rear substrate and surrounding the plurality of spacers, and of which an internal space surrounded by the front substrate, the rear substrate and the frame is maintained at pressure lower than atmospheric pressure, wherein both the front substrate and the rear substrate are made from glass material, the airtight container satisfies $H_1<H_2<H_3$, and $1.3(H_2-H_1)/L<(H_3-H_2)/W$, where $H_1$ is an average height of the spacers, $H_2$ is a height of an edge of the frame on a side of the internal space, $H_3$ is a height of an edge of the frame on a side opposite to the internal space, W is a width of the frame, and L is the predetermined interval.

12 Claims, 6 Drawing Sheets

AIRTIGHT CONTAINER AND IMAGE DISPLAYING APPARATUS USING THE SAME

BACKGROUND OF THE INVENTION

1. Field of the Invention

The present invention relates to an airtight container of which internal pressure has been reduced, an image displaying apparatus which uses the airtight container, and a television apparatus which uses the image displaying apparatus.

2. Description of the Related Art

A flat-panel image displaying apparatus using a field-emission electron-emitting device or a surface conduction electron-emitting device has been known. In general, the electron-emitting device is operated in an atmosphere (vacuum) which has a degree of vacuum higher than about $10^{-4}$ Pa and of which the internal pressure has been reduced. For this reason, an airtight container (i.e., a vacuum container) which has an atmospheric pressure resisting structure is necessary for the image displaying apparatus using the electron-emitting device. Here, since external force (atmospheric pressure) caused by a difference between an external pressure (atmospheric pressure) and an internal pressure (vacuum) is applied to the airtight container, the airtight container is compressed and thus deformed by the external force. More specifically, if the airtight container is excessively deformed, there is a possibility that relative positions of the electron-emitting device and a light emitter provided within the airtight container vary. Also, there is a possibility that the glass of the airtight container is broken because a stress concentrates on the surface of the glass. On the other hand, in recent years, a load to the airtight container tends to increase according as the screen of the flat-panel image displaying apparatus enlarges in size. For this reason, an image displaying apparatus which contains spacers for maintaining a space within an airtight container thereof has been proposed.

Hereinafter, a typical example of an airtight container of an image displaying apparatus in which an electron-emitting device is used will be described with reference to FIGS. 2A and 2B. More specifically, FIG. 2A is the two-dimensional schematic diagram illustrating an airtight container 99 in which spacers 4 and a frame 3 are visibly and schematically shown, and FIG. 2B is the cross section schematic diagram of the airtight container 99 viewed along the 2B-2B line indicated in FIG. 2A. The airtight container 99 includes a front substrate 1 on which a light emitter 5 such as a phosphor or the like and an anode 7 such as a metal back or the like are provided, a rear substrate 2 on which an electron source 6 is provided and which is arranged opposite to the front substrate 1, and a frame 3 which connects the front substrate 1 and the rear substrate 2 with each other at their peripheries. Each of the front substrate 1 and the rear substrate 2 is typically made of a glass plate. Further, within an internal space 98 of the airtight container 99 formed by the front substrate 1, the rear substrate 2 and the frame 3, the plate spacers 4 are arranged between the front substrate 1 and the rear substrate 2. Here, the frame 3 includes a frame member consisting of glass, metal or the like, and a bonding member consisting of frit, low-melting metal or the like. Further, the bonding member has a sealing function for connecting the front substrate 1, the rear substrate 2 and the frame member with others.

In recent years, thinning and lightening of the flat-panel image displaying apparatus has accelerated. Under the circumstances, it is required to further reduce the thickness of the glass plate constituting the front substrate 1 and the rear substrate 2. In this connection, Japanese Patent Application Laid-Open No. 2002-358915 and Japanese Patent Application Laid-Open No. H10-254375 respectively disclose a technique of making the height of a frame higher than the height of a spacer.

SUMMARY OF THE INVENTION

The present invention has been completed in order to solve such a problem as described above, and is characterized by providing an airtight container which has a front substrate, a rear substrate opposite to the front substrate, plural spacers arranged at a predetermined interval between the front substrate and the rear substrate, and a frame provided between the front substrate and the rear substrate and surrounding the plural spacers, and of which an internal space surrounded by the front substrate, the rear substrate and the frame is maintained at pressure lower than atmospheric pressure, wherein the airtight container satisfies $H_1<H_2<H_3$, and $1.3(H_2-H_1)/L<(H_3-H_2)/W$, where $H_1$ is an average height of the spacers, $H_2$ is a height of an edge (height of a side surface) of the frame on a side of the internal space, $H_3$ is a height of an edge (height of a side surface) of the frame on an opposite side of the side of the internal space, W is a width of the frame, and L is the predetermined interval.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

If the thickness of each of the front substrate 1 and the rear substrate 2 is reduced, a stress applied to each of the front substrate 1 and the rear substrate 2 increases. Consequently, it is conceivable to reduce the stress on the surface of each of the front substrate 1 and the rear substrate 2 by further reinforcing the support structure, for example, by increasing the number of the spacers 4 to be arranged. However, there is a limit to such a method because of necessary precisions of heights of the spacers 4 and the frame 3. Consequently, it is required to reduce the stress to be applied to each of the front substrate 1 and the rear substrate 2 by another method.

As suggested in Japanese Patent Application Laid-Open No. 2002-358915 and Japanese Patent Application Laid- Open No. H10-254375, if the height of the frame 3 is made higher than the height of the spacer, a compression stress is generated, immediately above the spacer, on the surface of each of the front substrate 1 and the rear substrate 2, whereby the strength of each substrate can increase. However, as a result of inventor's consideration, it was found that, if the height of the frame is made higher than the height of the spacer, a tensile stress larger than the compression stress on the surface of the substrate is generated immediately above the frame of which the height has been made higher than the height of the spacer, whereby there is a case where the overall stress of the airtight container reduces rather.

Therefore, the present invention aims to suppress decrease of the strength of the airtight container without sacrificing thinning and lightening of the airtight container.

According to the present invention, it is possible to give a predetermined warp to the substrate at the position immediately above the frame. As a result, it is possible to obtain the airtight container in which the stress generated on the substrate at the position immediately above the frame has been reduced.

Figure 1:
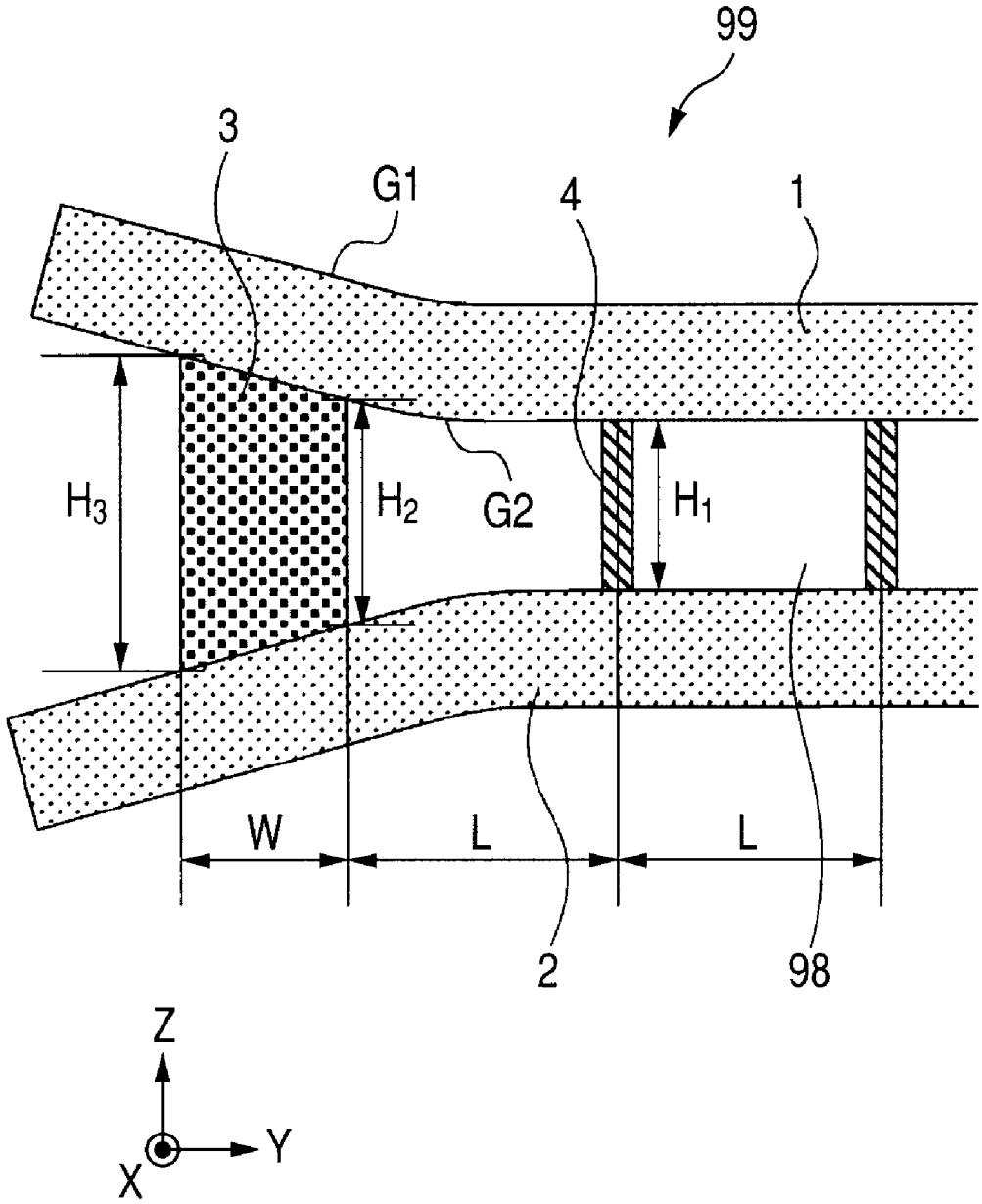
FIG. 1 a cross section schematic diagram illustrating a vicinity of a frame of an airtight container according to an embodiment of the present invention.

FIG. 1 a partial cross section schematic diagram illustrating a vicinity of a frame 3 of an airtight container 99 according to the embodiment of the present invention, and is the section diagram taken along the Y direction (i.e., a Y-direction section diagram). Further, FIG. 3 is a cross section schematic diagram illustrating in detail an example of the constitution of the frame 3 illustrated in FIG. 1. In FIG. 1, the constitution of the airtight container 99 other than the vicinity of the frame 3 is substantially the same as that of the conventional airtight container described with reference to FIGS. 2A and 2B. That is, the plane diagram of the airtight container 99 in FIG. 1 is not different from that in FIG. 2A, whereby a detailed description of the constitution of the airtight container 99 other than the vicinity of the frame 3 will be omitted here.

When the airtight container 99 is applied to an image displaying apparatus, at least plural image forming devices are arranged within an internal space 98 of the airtight container 99.

Each of the image forming devices can be constituted by a light emitter, and a means for supplying energy to cause the light emitter to emit light. Further, as the means for supplying energy, for example, an electron-emitting device can be used. In this case, in the same manner as illustrated in FIG. 2B, an electron source which includes numerous cold-cathode electron-emitting devices is arranged on a rear substrate 2. Here, as the cold-cathode electron-emitting device, for example, a Spindt-type field emission device, a surface-conduction filed emission device, an MIM (metal-insulator-metal) field emission device, or the like can be used, and a kind of such cold-cathode electron-emitting device is not specifically limited. Further, as the image forming device, for example, an inorganic EL (electro luminescence) device or an organic EL device can also be used. When the EL device is used as the image forming device, the image displaying apparatus which is equipped with the airtight container containing the image forming device acts as an EL display. The organic EL device has a structure that a light emitting layer is interposed between two electrodes constituting a pair of electrodes. Also, the image forming device can be constituted by a light emitter, and a plasma generator (i.e., an ultraviolet light generator) acting as the means for supplying energy for causing the light emitter to emit light. The image displaying apparatus which is equipped with the airtight container containing the image forming device like this acts as a plasma display.

Here, although pressure in the internal space 98 of the airtight container is not specifically limited, the pressure is at least pressure lower than atmospheric pressure.

Hereinafter, the airtight container will be described by taking a case where the above-described electron-emitting device is used as the means for supplying energy to cause the light emitter to emit light, as an example.

When the electron-emitting device is used, it is desirable to maintain the internal space 98 to have a degree of vacuum higher than $10^{-4}$ Pa. Further, in such a case, in the same manner as illustrated in FIG. 2B, the light emitter which emits light in response to irradiation of electrons emitted by the electron-emitting device is arranged on a front substrate 1 in the internal space 98. Here, as the light emitter, for example, a phosphor can be used. Further, a metal film (i.e., a metal back) which functions as an anode electrode is provided on the electron-source side of the light emitter.

As illustrated in FIG. 1, the airtight container 99 includes the rectangular front substrate 1, the rectangular rear substrate 2, and the frame 3 which is provided between the front substrate 1 and the rear substrate 2.

The frame 3, which is two-dimensionally the rectangular frame, is airtightly bonded to the front substrate 1 and the rear substrate 2. Each of the front substrate 1 and the rear substrate 2 is preferably made of a glass substrate, and the thickness thereof is practically set to 0.7 mm or more and 3.0 mm or less. If the substrate is too thin, a deformation thereof due to a difference between external and internal pressures of the airtight container 99 increases, whereby there occurs a concern about reliability as the airtight container. On the other hand, if the substrate is too thick, there occurs a problem that the weight of the substrate increases. In any case, the frame 3 defines the internal space 98 of the airtight container 99 by surrounding the space formed between the front substrate 1 and the rear substrate 2. For this reason, it can be said that the internal space 98 is the space which is surrounded by the front substrate 1, the rear substrate 2 and the frame 3. In the internal space 98, the front substrate 1 and the rear substrate 2 are oppositely arranged at a predetermined interval. Here, the interval between the front substrate 1 and the rear substrate 2 in the internal space 98 is maintained to, for example, 200 μm or more and 3 mm or less, and to, more practically, 1 mm or more and 2 mm or less. In any case, the interval between the front substrate 1 and the rear substrate 2 in the internal space 98 can be considered as an average height ($H_1$) of later-described spacers 4.

As can be understood from FIG. 1, the inner portions of the peripheries of the front substrate 1 and the rear substrate 2 are bonded to each other through the frame 3. As illustrated in FIG. 3, for example, the frame 3 is constituted by a frame member 31 consisting of glass, metal or the like, and a bonding member 32 for bonding the frame member 31, the front substrate 1 and the rear substrate 2 with others. Here, as the bonding member 32, for example, frit, low-melting metal such as In, Sn or the like, and an alloy of the low-melting metals such as In, Sn and the like can be used.

Since the frame member 31 is airtightly bonded with the front substrate 1 and the rear substrate 2 by means of the bonding member 32, the inner portion of the periphery of the front substrate 1 and the inner portion of the periphery of the rear substrate 2 are sealed off. Incidentally, the bonding member 32 is provided so as to be separated from the periphery of each of the front substrate 1 and the rear substrate 2 by a predetermined distance so that the bonding member 32 is positioned inside the periphery of each of the front substrate 1 and the rear substrate 2. As a result, the internal space 98 which is maintained at pressure lower than atmospheric pressure, the frame 3 which surrounds the internal space 98, and an atmospheric space (i.e., an external space) which surrounds the frame 3 exist between the front substrate 1 and the rear substrate 2.

The length (i.e., the width) of the frame 3 in the Y direction is not specifically limited, but is practically set to 3 mm or more and 8 mm or less. If the width is too narrow, there is a case where the internal space 98 of the airtight container 99 cannot be maintained at a predetermined degree of vacuum. On the other hand, if the width is too wide, an area occupied by the frame increases, and thus a portion other than an image displaying region increases, whereby a space-saving purpose is prevented. Incidentally, the width of the frame 3 is set not only in the Y direction but also over all surroundings of the internal space 98 within such a range as described above. Further, it is desirable to set the width of the frame constant.

Since the inner portion of the periphery of the front substrate 1 and the inner portion of the periphery of the rear substrate 2 are sealed (bonded), a peripheral portion which surrounds the frame 3 exists in the airtight container 99. In other words, the frame 3 exists between the internal space 98 of the airtight container 99 and the peripheral portion of the airtight container 99. The peripheral portion of the airtight container 99 is constituted by the peripheral portion of the rear substrate 2 positioned outside the region of the rear substrate 2 bonded with the frame 3 and the peripheral portion of the front substrate 1 positioned outside the region of the front substrate 1 bonded with the frame 3. In general, the area of the peripheral portion of the rear substrate 2 is larger than the area of the peripheral portion of the front substrate 1 for the purpose of wiring of the electron-emitting device and connection of a driving circuit.

In the internal space 98 of the airtight container 99, the plural plate spacers 4 each of which has the longitudinal direction in the X direction are provided to maintain the above-described interval between the front substrate 1 and the rear substrate 2. The number of the spacers is not specifically limited, but is practically set to five or more. The plate spacer 4 can be constituted by a long and narrow glass plate or a long and narrow ceramic plate. Further, a high-resistance film or concavity and convexity may be provided on the surface of the above plate according to necessity. With respect to the plate spacer 4, the height (i.e., the length in the Z direction) thereof is as large as the width (i.e., the length in the Y direction) thereof from several to tens of times. Further, although the length (i.e., the length in the X direction) of the spacer depends on the size of the airtight container, the relevant length is practically as large as the height thereof from tens of to hundreds of times.

The plural plate spacers 4 are arranged so that the adjacent two spacers are separated from each other by a predetermined interval L in the Y direction. Further, the interval (i.e., the shortest distance) between each of the two spacers, among the plural spacers, positioned at each of the both edges of the internal space in the Y direction and the X-direction edge of the frame 3 on the side of the internal space 98 is set to be the same as the interval L between the two spacers adjacent in the Y direction. Incidentally, the edge of the frame 3 on the side of the internal space 98 extending along the X direction (i.e., the edge extending in the X direction) and the longitudinal direction of the spacer are set to be parallel with each other. For this reason, the distance (i.e., the interval L) between the whole-length X-direction edge of each of the two spacers, among the plural spacers, positioned at each of the both edges of the internal space in the Y direction and the X-direction edge of the frame 3 on the side of the internal space 98 is substantially constant.

The above interval L (see FIG. 1) is practically set to 5 mm or more and 50 mm or less. If the interval L is shorter than 5 mm, there is a case where the spacer which is not in contact with the substrate exists due to dispersion (or unevenness) of the heights of the spacers. On the contrary, if the interval L is longer than 50 mm, there is a case where the glass substrate (1, 2) is destroyed due to a difference between the external and internal pressures of the airtight container 99.

Figure 2A:
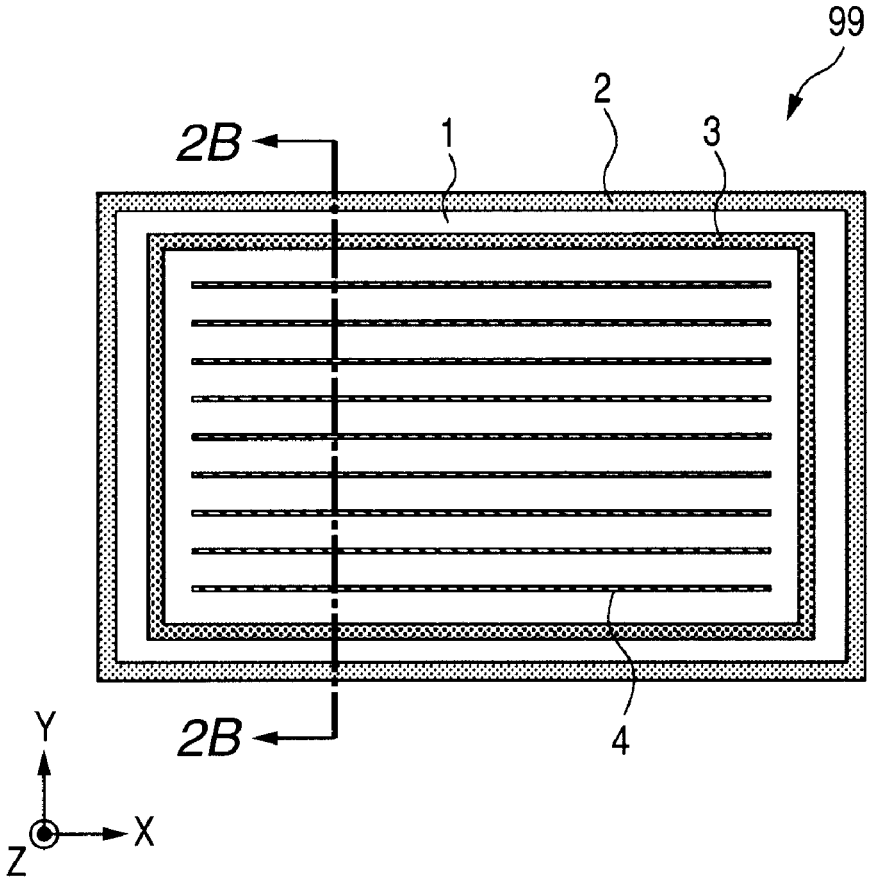
FIG. 2A is a two-dimensional schematic diagram illustrating the airtight container according to the embodiment of the present invention.
Figure 2B:
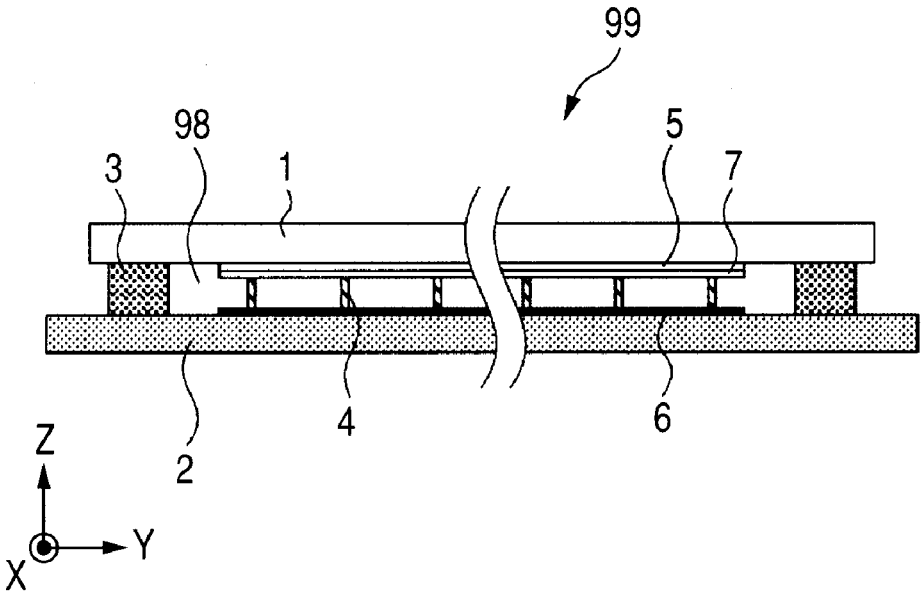
FIG. 2B is a cross section schematic diagram of the airtight container viewed along the 2B-2B line indicated in FIG. 2A.
Figure 3:
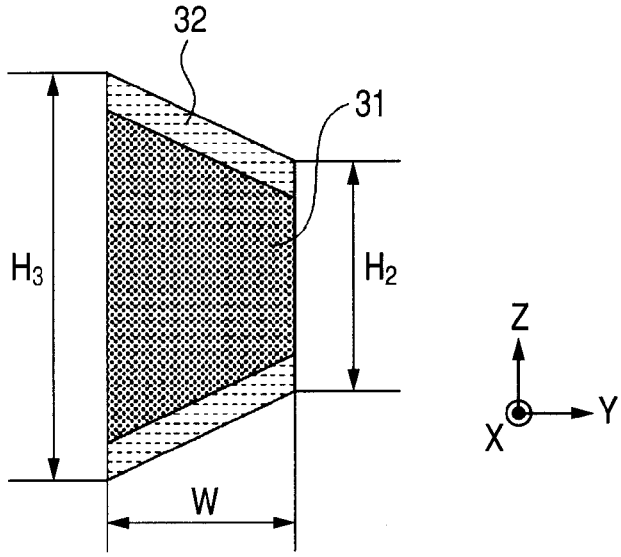
FIG. 3 is a cross section diagram illustrating an example of the frame according to the embodiment of the present invention.
Figure 4:
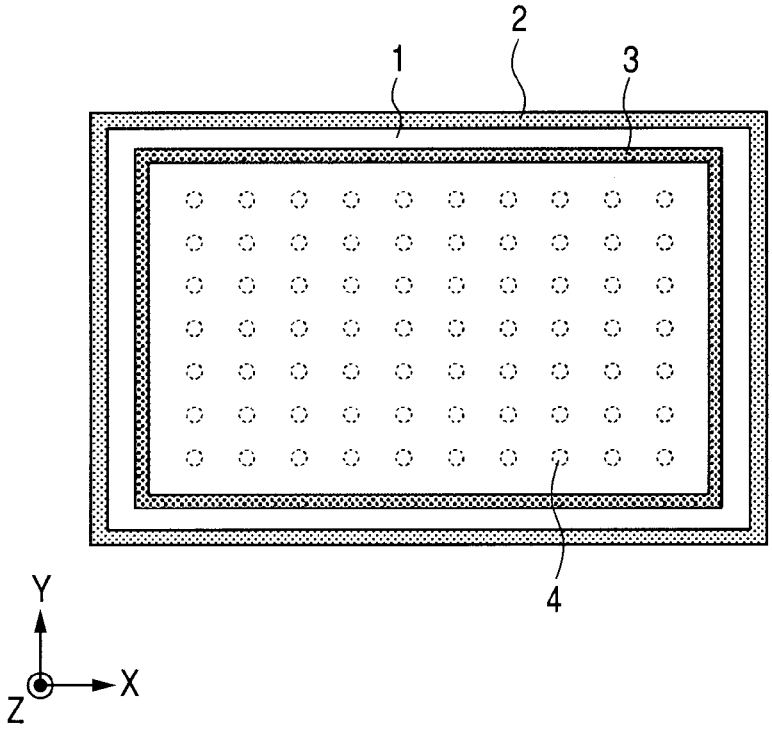
FIG. 4 is a two-dimensional schematic diagram illustrating the airtight container in which columnar spacers are used.

Incidentally, an example of the plate spacers as illustrated in FIG. 2A is described in the present embodiment. However, columnar spacers as illustrated in FIG. 4 may be used.

It is preferable to use the columnar spacer of which the occupation area is smaller than that of the plate spacer, for the purpose of reducing the weight of the airtight container. Further, if the columnar spacers are used, it is possible to adopt a grinding process when manufacturing the airtight container. For this reason, it is possible to accurately control the dispersion of the heights of the columnar spacers, although it is difficult to accurately control the dispersion of the heights of the plate spacers. In the present embodiment, the columnar spacer of which the section is circular is used as illustrated in FIG. 4. However, it is possible to also use a quadrangle-columnar spacer of which the section is quadrangular or a polygon-columnar spacer of which the section is polygonal. When the columnar spacers are used, it is desirable to arrange them like a matrix as illustrated in FIG. 4. In the plural columnar spacers 4, the number of the columnar spacers arranged in one row is the same as the number of the columnar spacers arranged in each of other rows, and the number of the columnar spacers arranged in one column is the same as the number of the columnar spacers arranged in each of other columns. That is, it is desirable to arrange the plural columnar spacers in m rows and n columns. More specifically, the m columnar spacers are linearly arranged in each row at the above-described intervals L, and the n columnar spacers are linearly arranged in each column at the above-described intervals L. Further, each row is set to be in parallel with one of the X direction and the Y direction, and each column is set to be in parallel with the other of the X direction and the Y direction. When the plate spacers are used, FIG. 1 is considered as the schematic section diagram of the airtight container 99 in the direction (Y direction) perpendicular to the longitudinal direction (X direction) of the plate spacers. On the other hand, when the columnar spacers arranged in the m rows and the n columns are used, FIG. 1 is considered as the schematic section diagram of the airtight container 99 in the direction (Y direction) taken along either the row (m) or the column (n) having the larger number. Further, it is possible to use two or more kinds of spacers as the plural spacers. For example, it is possible to use the plate spacers and the columnar spacers together.

Furthermore, the interval between each of the two spacers, among the plural spacers, positioned at each of the both edges in the Y direction and the edge of the frame 3 on the side of the internal space 98 extending along the X direction is set to be the same as the interval L between the adjacent spacers, as described above.

Incidentally, when the plate spacers are used, the number of the spacers respectively positioned at the both edges in the Y direction is two. On the other hand, when the columnar spacers are used, if each row is in parallel with the Y direction, the number of the spacers positioned at the both edges in the Y direction is 2×m. Further, if each row is in parallel with the X direction, the number of the spacers positioned at the both edges in the Y direction is 2×n.

On another front, the interval (i.e., the shortest distance) between the edge of the frame 3 on the side of the internal space 98 extending along the Y direction and the plural spacers positioned at both edges in the X direction is not specifically limited as long as an effect of the present invention later described in detail can be derived. More specifically, the above-described interval may be set to the Y-direction spacer interval L or less, but it is practically desirable to set the above-described interval to be the same as the Y-direction spacer interval L. Incidentally, when the columnar spacers are used, if each row is in parallel with the Y direction, the interval between the columnar spacers positioned at each of the first row and the last row and the edge of the frame 3 on the side of the internal space 98 extending along the Y direction may be set to the above-described interval L or less. Further, when the plate spacers as illustrated in FIG. 2A are used, it is desirable to align both edges of all the spacers in the X direction (that is, it is desirable to set both edges of all the spacers in the X direction to be in parallel with the edge of the frame 3 on the side of the internal space 98 extending along the Y direction).

Further, when the columnar spacers are used, it is desirable to set the shortest distance between each of the columnar spacers positioned at the both edges of each row and the frame 3 to be constant, and it is also desirable to set the shortest distance between each of the columnar spacer positioned at the both edges of each column and the frame 3 to be constant.

Incidentally, when the airtight container 99 is used for the image displaying apparatus, since each of the front substrate 1 and the rear substrate 2 is rectangular, it is desirable to set the frame 3 to be rectangular. In this case, it is desirable to set the edge of the frame 3 on the side of the internal space 98 to be rectangular as illustrated in FIGS. 2A and 2B.

As described above, since the plural spacers 4 are positioned in the internal space 98, the frame 3 resultingly surrounds the plural spacers 4.

If the airtight container 99 illustrated in FIG. 1 is constituted to have a shape which satisfies a later-described specific condition, a later-described predetermined warp is given to each of the front substrate and the rear substrate 2 respectively adjacent to the frame 3. Thus, it is possible to reduce the stress on the surface of the substrate (1, 2) adjacent to the frame 3. Here, the specific condition for reducing the stress on the surface of the substrate (1, 2) can be derived by using a theoretical calculation in mechanics of materials.

That is, from an instruction book of mechanics of materials, a mechanical engineering manual or the like, it is understood that, when a uniform load ω is applied to the whole of one side for a simple support beam model of which the both edges are supported as fixed edges, a maximum bending moment is generated at the both fixed support edge portions.

Then, if it is assumed that the distance between the above both edges is L, an absolute value $|M_{max}|$ of the bending moment is expressed by $\omega L^2/12$.

If the above matter is expanded, as a problem of an indeterminate beam, to the spacer portion being the plural support portions existing apart from the frame portions being the both fixed support edge portions by the distance L, it is possible to conceive increase and decrease of the bending moment due to the shape of the frame portion.

At this time, when it is assumed that a difference h between the height of the fixed edge support portion and the height of another support portion is given and the fixed edge support portion has an inclination θ, a bending moment $M_0$ of the beam of the fixed edge support portion is given by the following expression (1).

$$M_0=\omega L^2/12+(EI/L)\cdot\{\alpha_0 h/L-\alpha_1\theta\} \quad (1)$$

where E is a Young's modulus of the beam, and I is a section second moment.

Here, the values of the coefficients $\alpha_0$ and $\alpha_1$ in the second term of the expression (1) change according to the number of the spacers to be considered. More specifically, these values converge on a certain value according as the number of the spacers increases. When the number of the spacers to be considered is five or more, $\alpha_0\approx4.4$ and $\alpha_1\approx3.5$ are obtained.

Here, when it is assumed that a state in which both the difference h between the height of the fixed edge support portion and the height of another support portion and the inclination θ of the fixed edge support portion are 0 is an ordinary state, the bending moment in this state is $\omega L^2/12$ which is the same as that for the simple support beam model. Incidentally, the ordinary state described here simply includes a state that the bonded surface (i.e., an interface) between the front substrate 1 and the frame 3 is in parallel with the bonded surface (i.e., an interface) between the rear substrate 2 and the frame 3 as illustrated in FIG. 2B. Further, the ordinary state includes a state that the shortest distance (in the Z direction) between the front substrate 1 and the rear substrate 2 at the portion in which the spacer is interposed between these substrates is the same as the shortest distance (in the Z direction) between the front substrate 1 and the rear substrate 2 at the portion in which the frame is interposed between these substrates.

On the other hand, when it is assumed that the difference h between the height of the fixed edge support portion and the height of another support portion has a value exceeding 0 but the inclination θ is 0, the second term of the expression (1) has a value exceeding 0, whereby it is understood that the bending moment $M_0$ increases from $\omega L^2/12$ being the value in the ordinary state. At this time, a load exceeding the load in the ordinary state is generated on the beam immediately above the frame portion being the fixed support edge. For this reason, when the height of the frame is simply made higher than the height of the spacer as disclosed in Japanese Patent Application Laid-Open No. 2002-358915, the load exceeding the load in the ordinary state is generated.

In regard to this point, when the inclination θ has a value satisfying the condition in the following expression (2), the value of the second term of the expression (1) can be less than 0 although the difference h exceeds 0.

$$(\alpha_0/\alpha_1)\cdot h/L<\theta \quad (2)$$

At this time, the bending moment $M_0$ falls below $\omega L^2/12$ being the value in the ordinary state. Incidentally, in the expression (2), $\alpha_0/\alpha_1\approx4.4/3.5=1.3$ is satisfied.

From the above matter, a condition for reducing the stress generated on a surface G1 of the atmosphere-side glass immediately above the frame 3 as compared with that in the ordinary state is given as condition 1 below. Incidentally, in condition 1, as illustrated in FIG. 1, an average height of the spacers 4 is set to $H_1$, the height of the edge of the frame 3 (the height of the side surface of the frame 3) on the side of the internal space 98 is set to $H_2$, the height of the edge of the frame 3 (the height of the side surface of the frame 3) on the opposite side (i.e., the atmosphere side) of the side of the internal space 98 is set to $H_3$, the distance between the adjacent spacers is set to L, and the width of the frame is set to W. Further, the difference h of the heights is converted to $(H_2-H_1)/2$, and the inclination θ is converted to $(H_3-H_2)/2W$.

$$\text{satisfying } H_1<H_2<H_3, \text{ and } 1.3(H_2-H_1)/L<(H_3-H_2)/W \quad \text{(condition 1)}$$

At this time, a proper warped shape is given to each of the front substrate 1 and the rear substrate 2, whereby it is possible to reduce the stress generated, at the position immediately above the frame 3, on the surface G1 of each of the front substrate 1 and the rear substrate on the side (i.e., the atmosphere side) touching the atmosphere, as compared with the stress in the ordinary state.

Incidentally, the surface G1 can be considered as a part of the surface of each of the front substrate 1 and the rear substrate 2 on the side (i.e., the atmosphere side) touching the atmosphere and the portion positioned immediately above the edge of the frame 3 on the side of the internal space 98. Further, on each of the atmosphere-side surfaces (i.e., the surfaces on the side of the atmosphere) of the front substrate 1 and the rear substrate 2, strictly speaking, the portion where the maximum stress is generated in the vicinity of the frame 3 changes according to the conditions of the thickness and the inclination of each of the front substrate 1 and the rear substrate 2. Consequently, there is a case where the surface G1 is shifted from the position immediately above the edge of the frame 3 on the side of the internal space 98. For example, there is a case where the surface G1 is positioned on the portion shifted toward the side of the internal space 98 from the portion immediately above the edge of the frame 3 on the side of the internal space 98. However, as described above, the surface G1 can be simply considered as the portion positioned immediately above the edge of the frame 3 on the side of the internal space 98.

Since the atmosphere-side surface of each of the front substrate 1 and the rear substrate 2 is deteriorated due to moisture included in the atmosphere, the strength of the atmosphere-side surface of each of the front substrate and the rear substrate 2 is low as compared with the strength of the vacuum-side surface (i.e., the surface on the side of the internal space) of each of the front substrate 1 and the rear substrate 2. Consequently, it is vital to lower the stress generated on the atmosphere-side surface G1 of each of the front substrate 1 and the rear substrate 2 according to condition 1 for the purpose of an increase of the strength of the airtight container 99.

Incidentally, when the plate spacers each of which has the longitudinal direction in the X direction are used, as illustrated in FIG. 1, the spacers 4 discretely exist on the Y-direction section (i.e., the section taken along the Y direction) of the airtight container 99 (that is, the spacers 4 are spaced on the Y-direction section). However, the spacers continuously exist on the X-direction section (i.e., the section taken along the X direction) of the airtight container 99. Consequently, when the plate spacers are used, a mechanism of generating the stress on the above-described substrate (1, 2) on the X-direction section of the airtight container 99 is different from a mechanism of generating the stress on the above-described substrate (1, 2) on the Y-direction section of the airtight container 99. For this reason, it is desirable to decrease the stress generated in the G1 portion of the substrate (1, 2) on the X-direction section as compared with the stress generated in the same portion on the Y-direction section of the airtight container in the ordinary state. To achieve this, it is required to set the inclination on the X-direction section to be slightly higher than the inclination on the Y-direction section (that is, to make the respective warps of the front substrate 1 and the rear substrate 2 on the X-direction section large). For example, the distance (i.e., the shortest distance) between each of the two spacers, among the plural plate spacers, positioned at each of the both edges in the Y direction and the edge of the frame 3 on the side of the internal space 98 extending along the X direction is the above-described interval L and the interval (i.e., the shortest distance) between each of the both edges of the plate spacer 4 in the X direction and the edge of the frame 3 on the side of the internal space 98 extending along the Y direction is the above-described interval L or less, it is desirable for the airtight container 99 to satisfy condition 1 on the Y-direction section and, on the other hand, practically satisfy $H_1<H_2<H_3$, and $5(H_2-H_1)/L<(H_3-H_2)/W$.

Incidentally, the difference $(H_2-H_1)$ between the height $H_2$ of the edge of the frame 3 on the side of the internal space 98 and the height $H_1$ of the spacer is practically set to 4 μm or more and 30 μm or less. Further, the value $\{(H_3-H_2)/W\}$ which is obtained by dividing the difference between the height $H_3$ of the edge of the frame 3 on the opposite side (i.e., the atmosphere side) of the side of the internal space 98 and the height $H_2$ of the edge of the frame on the side of the internal space 98 by the width W of the frame 3 is practically set to 0.5 μm/mm or more and 2.5 μm/mm or less.

Here, it is possible to also obtain the constitution illustrated in FIG. 1 by adjusting, for example, the shape of the frame member 31, the position of a fixing pin for pressing one of the front substrate 1 and the rear substrate 2 toward the other of the substrates when sealing them, or the load for pressing the substrates.

Giving the warps as illustrated in FIG. 1 leads to increase the stress on a surface G2 being the surface on the side of the internal space 98 between the front substrate 1 and the rear substrate 2 and positioned in the vicinity of the frame 3. Consequently, it is further desirable that the stress on the surface G2 satisfies the condition which falls below the stress on the portion of the surface G1 on the atmosphere side of each of the front substrate 1 and the rear substrate 2 in the ordinary state.

Incidentally, the surface G2 can be considered as a part of the surface of each of the front substrate 1 and the rear substrate 2 on the side of the internal space 98 (i.e., the vacuum side) and the portion positioned immediately above the edge of the frame 3 on the side of the internal space 98. Further, on each of the surfaces of the front substrate 1 and the rear substrate 2 on the side of the internal space 98 (i.e., the vacuum side), strictly speaking, the portion where the maximum stress is generated in the vicinity of the frame 3 changes according to the conditions of the thickness and the inclination of each of the front substrate 1 and the rear substrate 2. Consequently, there is a case where the surface G2 is shifted from the position immediately above the edge of the frame 3 on the side of the internal space 98. For example, there is a case where the surface G2 is positioned on the portion shifted toward the side of the internal space 98 from the portion immediately above the edge of the frame 3 on the side of the internal space 98. However, as described above, the surface G2 can be simply considered as the portion positioned immediately above the edge of the frame 3 on the side of the internal space 98.

The bending moment $M_0$ expressed in the above-described expression (1) is required to satisfy the following expression (3) so that the stress on the surface G2 satisfies the condition which falls below the stress on the portion of the atmosphere-side surface G1 of each of the front substrate 1 and the rear substrate 2 in the ordinary state.

$$M_0>-\omega L^2/12 \tag{3}$$

Then, the following expressions (4) and (5) are derived from the expressions (1) and (3).

$$0<\omega L^2/6+(EI/L)\cdot\{\alpha_0 h/L-\alpha_1\theta\} \tag{4}$$

$$\theta<(\alpha_0/\alpha_1)h/L+\omega L^3/6\alpha_1 EI \tag{5}$$

Here, it is assumed that the difference between the internal and external pressures of the airtight container 99 is P, the Young's modulus of the substrate used for the front substrate 1 and the rear substrate 2 is E, and the thickness of each of the front substrate 1 and the rear substrate 2 is t. Under the circumstances, when the uniform load ω and the section second moment I are converted, the following expression (6) can be derived from the expression (5).

$$\theta<(\alpha_0/\alpha_1)h/L+2PL^3/\alpha_1 Et^3 \quad (6)$$

Here, when the difference h of the heights and the inclination θ of the frame 3 are converted as well as the deriving of condition 1, condition 2 by which the stress generated on the surface G2 of each of the front substrate 1 and the rear substrate 2 on the side of the internal space 98 and immediately above the frame 3 is reduced as compared with the stress in the ordinary state is expressed as below, on the basis of the expression (6).

$$\text{satisfying } (H_3-H_2)/W<1.3(H_2-H_1)/L+1.1PL^3/Et^3 \quad \text{(condition 2)}$$

Giving the warps as illustrated in FIG. 1 leads to increase the stress on the portion of the surface G2 being the surface on the side of the internal space 98 between the front substrate 1 and the rear substrate 2. However, by satisfying condition 2, it is possible to keep the stress on the portion of the surface G2 lower than the stress generated on the portion of the atmosphere-side surface G1 of the glass immediately above the frame in the ordinary state.

Besides, it is further desirable to reduce the stress on the spacer closest to the frame 3 to be lower than the stress in the ordinary state, and condition 3 to achieve this is derived as follows.

When the dispersion of the heights of the spacers is considered as $\Delta H_1$, a bending moment $M_1$ immediately above the spacer can be expressed as the following expression (7).

$$M_1=\omega L^2/12+\beta_0(EI/L)\cdot\{-3h/L-3.5\Delta H_1/2L+\theta\} \quad (7)$$

Here, the coefficient $\beta_0$ is the value which changes according to the number of the spacers to be considered, as well as the coefficients $\alpha_0$ and $\alpha_1$ in the expression (1). More specifically, when the five or more spacers are considered, $\beta_0\approx0.93$ is obtained.

When the second term of the expression (7) has a value less than 0, the bending moment $M_1$ is reduced to be lower than that in the ordinary state. At this time, when the conversion is performed as well as condition 1 and condition 2, condition 3 is obtained as below.

$$\text{satisfying } (H_3-H_2)/W<3(H_2-H_1)/L+3.5(\Delta H_1/L) \quad \text{(condition 3)}$$

At this time, the stress generated on the atmosphere-side surface of each of the front substrate 1 and the rear substrate 2 immediately above the spacer closest to the frame 3 is reduced to be lower than that in the ordinary state. Although the dispersion of the heights of the spacers tends to be smaller than the dispersion of the heights of the frame 3, the stresses generated immediately above the respective spacers can be reduced to be lower than that in the ordinary state by satisfying condition 3.

The airtight container 99, which satisfies the shape according to condition 1 to condition 3 and is illustrated in FIG. 1, can reduce the stress which is generated on the surfaces of the front substrate 1 and the rear substrate 2 due to the difference between the internal and external pressures of the airtight container, as compared with the conventional airtight container illustrated in FIG. 2B. As a result, the image displaying apparatus, which is constituted by providing the airtight container 99 illustrated in FIG. 1, and by further providing, in the airtight container 99, the electron-emitting device and the light emitter of emitting light in response to irradiation of electrons emitted by the electron-emitting device, can secure long-standing reliability.

Although the frame 3 can be constituted by the frame member 31 and the bonding member 32 as illustrated in FIG. 3, the shape itself of the frame member 31 is not limited to such a rough trapezoid as illustrated in FIG. 3. That is, section shape obtained by integrating the frame member 31 and the bonding member 32 may have a rough trapezoid satisfying condition 1 to condition 3, after the bonding member 32 was hardened.

Figure 5A:
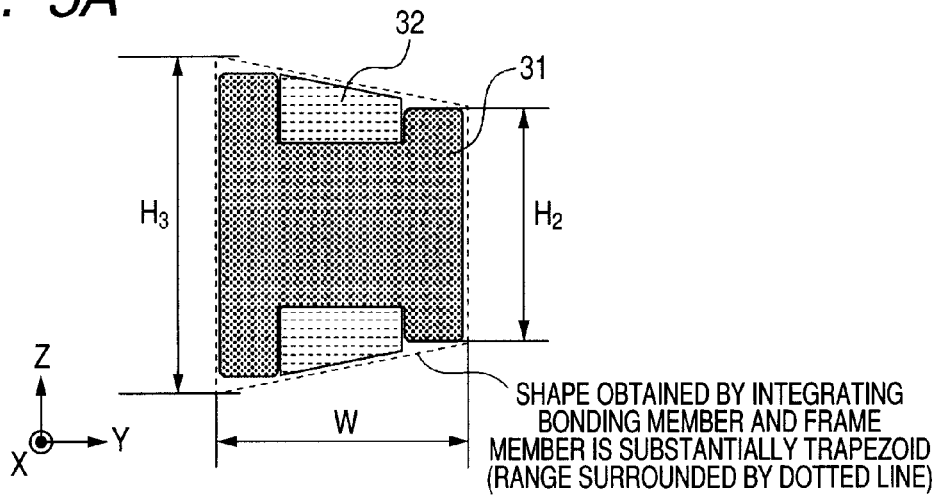
FIGS. 5A, 5B and 5C are diagrams respectively illustrating modified examples of the frame.
Figure 5B:
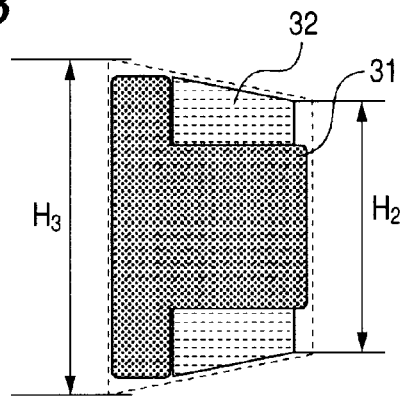
Figure 5C:
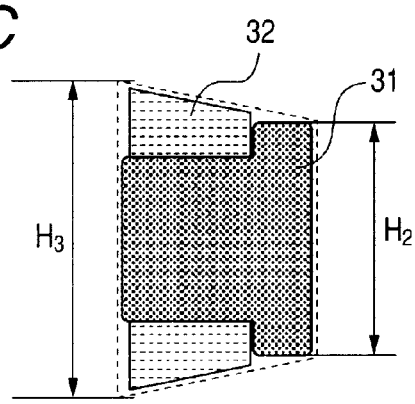

More specifically, plural section shapes as illustrated in FIGS. 5A to 5C are conceivable.

In FIG. 5A, the frame member 31 has an H-shaped section, and the height $H_2$ of the edge of the frame on the side of the internal space 98 is lower than the height $H_3$ of the edge of the frame on the atmosphere side. The bonding member 32 is provided in the recess between the both edges. Thus, after melting and cooling the bonding member 32, the shape obtained by integrating the frame member 31 and the bonding member 32 may become the rough trapezoid as indicated by the dotted line, and satisfy condition 1 to condition 3.

In FIG. 5B, the frame member 31 has a section obtained by inclining the character "T" by 90°. Thus, after melting and cooling the bonding member 32, the shape obtained by integrating the frame member 31 and the bonding member 32 may become the rough trapezoid as indicated by the dotted line, and satisfy condition 1 to condition 3. In FIG. 5A, there is a fear that the bonding member 32 overflows at the time of sealing because the bonding member are occluded by the frame member 31 from three directions, whereby it is necessary to strictly set the amount of the bonding member 32. However, in FIG. 5B, the bonding member 32 are occluded only from two directions, whereby it is possible to prevent the bonding member 32 from overflowing. For this reason, it is possible to manufacture the airtight container of which the process stability and the mechanical reliability are high.

In FIG. 5C, the frame member 31 itself has a T-shaped section of which the direction is opposite to the T-shaped section illustrated in FIG. 5B. Thus, after melting and cooling the bonding member 32, the shape obtained by integrating the frame member 31 and the bonding member 32 may become the rough trapezoid as indicated by the dotted line, and satisfy condition 1 to condition 3. As well as FIG. 5B, it is possible to expect an effect of preventing the bonding member 32 from overflowing. In addition, even if the amount of the bonding member 32 is excessive, it is possible to prevent the bonding member 32 from protruding toward the side of the internal space because the portion of the frame member 31 on the side of the internal space acts as a barrier. For this reason, it is possible to manufacture the airtight container of which the process stability and the mechanical reliability are high.

Figure 6A:
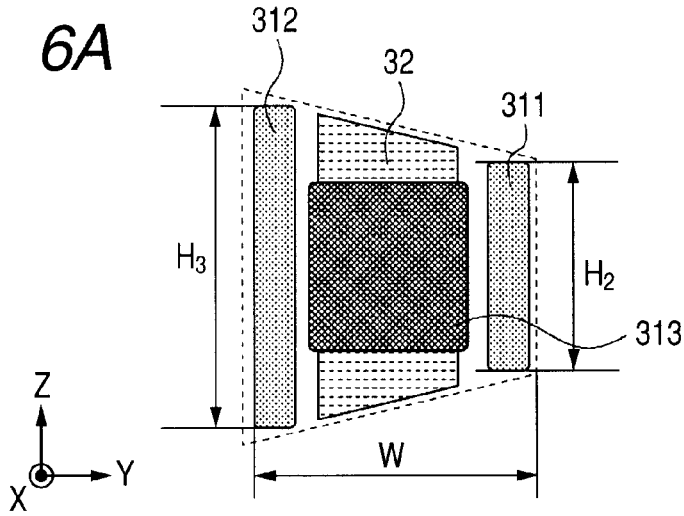
FIGS. 6A, 6B and 6C are diagrams respectively illustrating other modified examples of the frame.
Figure 6B:
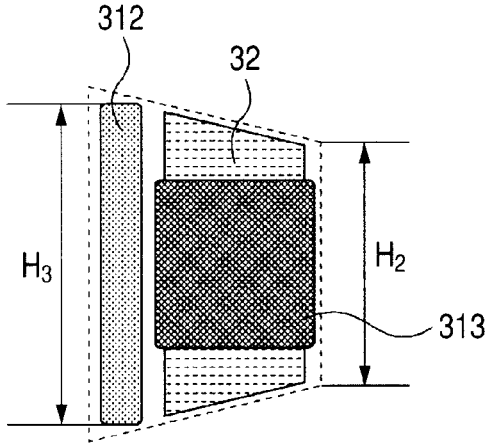
Figure 6C:
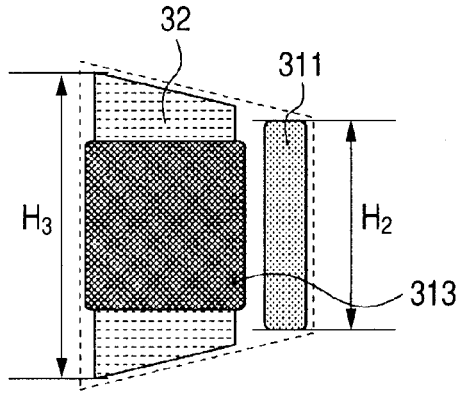

In the meantime, when it is difficult in terms of technique and costs to form the frame member 31 which has a complicated shape including differences of heights of several to tens of micrometers, it is possible to form the frame member by properly combining plural kinds of members, as illustrated in FIGS. 6A to 6C.

FIG. 6A illustrates an example in which the shape similar to that illustrated in FIG. 5A is formed by combining a core member 313 consisting of a metal material, an edge member 311 consisting of glass and being positioned on the side of the internal space, and an edge member 312 consisting of glass and being positioned on the side of the atmosphere being opposite to the side of the internal space. Likewise, FIG. 6B illustrates an example in which the shape similar to that illustrated in FIG. 5B is formed, and FIG. 6C illustrates an example in which the shape similar to that illustrated in FIG. 5C is formed.

In each of FIGS. 6A to 6C, the edge members 311 and 312 respectively consisting of the glass are arranged in the close vicinity of the core member 313 consisting of the metal material. When the edge member 311 positioned on the side of the internal space and the core member 313 are too away, it becomes impossible to disregard influences of deformations of the rear substrate and the front substrate due to atmospheric pressure between the edge member 311 and the core member 313, whereby it becomes impossible to maintain the intended rough trapezoid. This is the reason why it is necessary to set the edge member 311 in the vicinity of the core member 313. In the present embodiment, the core member 313 consists of the metal material and each of the edge members 311 and 312 consists of the glass. However, as the materials constituting the core member and the edge member, either the same material or the different materials can be used.

As illustrated in FIGS. 6A to 6C, it is possible to substitute the combination of the simple-shaped members for the complicated-shaped frame member 31, whereby it is possible to reduce the costs by using relatively simple technique.

Incidentally, in the present embodiment, the height $H_2$ is equivalent to the height of the edge of the frame 3 on the side of the internal space 98 and the height $H_3$ is equivalent to the height of the edge of the frame 3 on the opposite side (i.e., the atmosphere side) of the side of the internal space 98. However, on the section of the airtight container 99, the height $H_2$ can be considered as the height to be defined between the point which is positioned, in the portion where the front substrate 1 and the frame 3 are bonded to each other, on the side closest to the internal space 98 and the point which is positioned, in the portion where the rear substrate 2 and the frame 3 are bonded to each other, on the side closest to the internal space 98. Likewise, on the section of the airtight container 99, the height $H_3$ can be considered as the height to be defined between the point which is positioned, in the portion where the front substrate 1 and the frame 3 are bonded to each other, on the side closest to the external space and the point which is positioned, in the portion where the rear substrate 2 and the frame 3 are bonded to each other, on the side closest to the external space. Incidentally, the side closest to the external space implies the side of the frame 3 opposite to the side of the internal space 98 (i.e., the side of the frame 3 touching the atmosphere) between the front substrate 1 and the rear substrate 2.

Further, the shape which is the same as the shape (section shape) of the airtight container 99 being in the vicinity of the frame 3 described with reference to FIG. 1 may basically be applied to the circumference of the frame 3. However, when the plate spacers are used, it is desirable to set the inclination of the portion of the frame 3 extending along the Y direction (that is, the portion positioned on the extension line of the plate spacer in its longitudinal direction) to be larger than the inclination of the portion of the frame 3 extending along the X direction. That is, it is desirable to set the warp amount of each of the front substrate 1 and the rear substrate 2 in the vicinity of the frame on the X-direction section of the airtight container 99 to be larger than the warp amount of each of the front substrate 1 and the rear substrate 2 in the vicinity of the frame on the Y-direction section of the airtight container 99. This is because the spacers dispersedly exist at the predetermined intervals L on the Y-direction section of the airtight container 99 (see FIG. 1), while the spacer continuously exists on the X-direction section (i.e., the section including the plate spacer) of the airtight container 99. Therefore, when the plate spacers are used, it is desirable to change $1.3(H_2-H_1)/L<(H_3-H_2)/W$ in the relation expression of condition 1. More specifically, it is desirable to satisfy $1.5(H_2-H_1)<(H_3-H_2)/W$ as a practical range. In this case, it is practical to set the height $H_3$ in the portion of the frame 3 extending along the Y direction to be the same as the height $H_3$ in the portion of the frame 3 extending along the X direction. On the other hand, when the columnar spacers are used, the section of the airtight container 99 in the Y direction is substantially the same as the section of the airtight container 99 in the X direction. Consequently, the section of the airtight container 99 being in the vicinity of the portion of the frame 3 extending along the Y direction may be set to be the same as the section of the airtight container 99 being in the vicinity of the portion of the frame 3 extending along the X direction. In brief, the section shape of the airtight container 99 may be set to have the same shape for the entire circumference of the frame 3.

Figure 7:
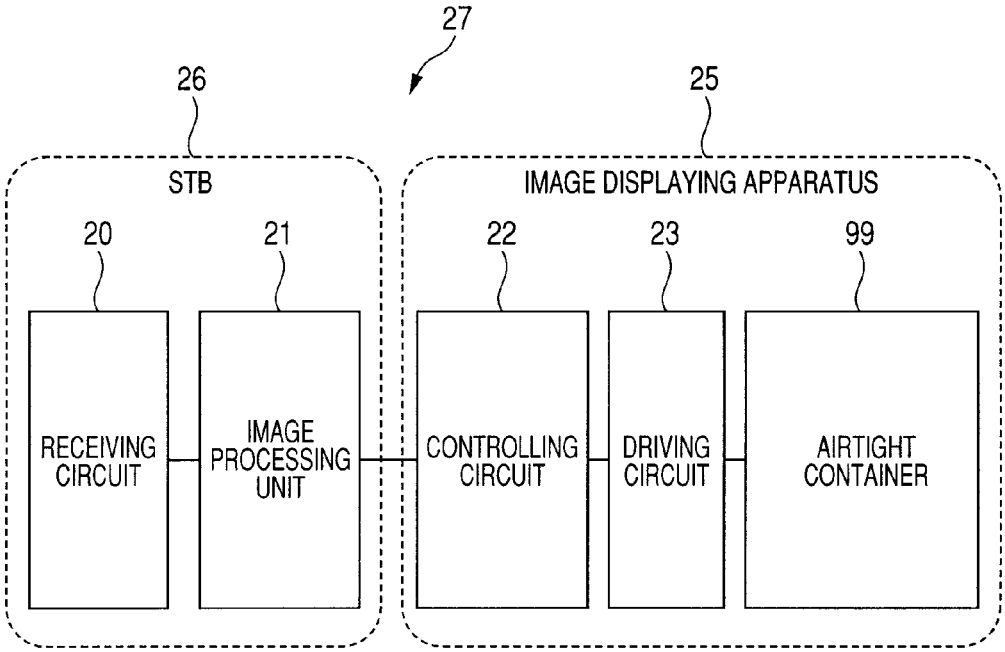
FIG. 7 is a block diagram illustrating a television apparatus to which the embodiment of the present invention is applied.

Subsequently, an image displaying apparatus 25 having the above-described airtight container 99, and a television apparatus 27 will be described with reference to a block diagram illustrated in FIG. 7.

A receiving circuit 20, which is constituted by a tuner, a decoder and the like, receives television signals of satellite broadcasting, ground-based broadcasting and the like, data of data broadcasting through a network, and the like, and then outputs decoded video data to an image processing unit 21. Here, the image processing unit 21, which includes a gamma correcting circuit, a resolution converting circuit, an I/F (interface) circuit and the like, converts the image-processed video data into image data having a display format conforming to the image displaying apparatus 25, and then outputs the obtained image data to the image displaying apparatus 25.

The image displaying apparatus 25 includes the airtight container 99, and at least the electron-emitting device, the anode and the light emitter respectively provided within the airtight container 99. Further, the image displaying apparatus 25 includes a driving circuit 23 for driving an image forming device, and a controlling circuit 22 for controlling the driving circuit. The driving circuit 23 is connected to the wiring which is connected to the image forming device. The controlling circuit 22 performs signal processes such as a correction process and the like to the input image data, and outputs the processed image data and various control signals to the driving circuit 23. Further, the controlling circuit 22 includes a sync signal separating circuit, an RGB converting circuit, a luminance data converting unit, a timing controlling circuit, and the like. The driving circuit 23 outputs a driving signal to the image forming device within the airtight container 99 on the basis of the input image data, thereby displaying television video based on the driving signal. The driving circuit 23 includes a scanning circuit, a modulating circuit and the like. Incidentally, the receiving circuit 20 and the image processing unit 21 may be held as an STB (set top box) 26 in a chassis which is separated from the image displaying apparatus 25. Alternatively, the receiving circuit 20 and the image processing unit 21 may be held in a chassis which is united with the image displaying apparatus 25. Incidentally, the example that the television apparatus 27 displays the television video is described in the present embodiment. However, if it is assumed that the receiving circuit 20 acts as a circuit for receiving videos delivered through lines such as the Internet and the like, the television apparatus 27 functions as a video displaying apparatus capable of displaying various videos in addition to the television videos.

Hereinafter, concrete examples will be described.

Example 1

FIG. 1 the partial cross section schematic diagram illustrating the vicinity of the frame 3 of the airtight container 99 which is manufactured in this example, and FIG. 3 is the enlarged cross section diagram illustrating the detailed constitution of the frame 3 illustrated in FIG. 1. The airtight container according to this example is the airtight container which satisfied condition 1 described above. Although not illustrated in FIG. 1, as well as the airtight container illustrated in FIG. 2B, in the internal space 98 of the airtight container 99, the light emitter 5 consisting of phosphor and the metal back (anode) 7 consisting of aluminum are provided on the front substrate 1, and the electron source 6 and the like are provided on the rear substrate 2. Further, the plan schematic diagram of the airtight container 99 in this example is the same as the schematic diagram illustrated in FIG. 2A. That is, in the section along the 2B-2B line in FIG. 2A, the portion obtained by enlarging the vicinity of the frame 3 is equivalent to FIG. 1.

In this example, a glass plate having the thickness 1.8 mm is used as each of the front substrate 1 and the rear substrate 2, and the Young's modulus E of this glass plate is 77 GPa. Further, as illustrated in FIG. 3, the frame 3 is constituted by the frame member 31 consisting of Al, and the bonding member 32 consisting of the alloy of In and Sn. Here, the width W of the frame 3 is 6 mm, and the width of the frame 3 is constant over the entire circumference thereof including the internal space. Further, the plural plate spacers 4 each consisting of the glass plate are arranged within the internal space 98 of the airtight container 99. Here, the interval L between the adjacent spacers 4 is 19 mm, the thickness of each spacer 4 is 200 μm, and the average height $H_1$ of the spacers is 1.6 mm. Further, the shortest distance between the edge of the frame 3 positioned on the side of the internal space and extending along the longitudinal direction of the spacer and the spacer is set to 19 mm, and the shortest distance between the edge of the frame 3 positioned on the side of the internal space and extending along the direction perpendicular to the longitudinal direction of the spacer and the spacer is also set to 19 mm.

The numerous surface conduction electron-emitting devices which act as the electron source 6 are provided on the rear substrate 2 within the internal space 98 of the airtight container 99, and each of the electron-emitting devices is connected to the scanning wiring and the signal wiring which have been formed respectively by baking conductive pastes including silver granules.

On the other hand, the phosphor which emits light in response to irradiation of electrons emitted by the electron-emitting devices, and the metal back which consists of an aluminum film acting as the anode electrode formed on the phosphor are provided on the front substrate 1.

More specifically, the airtight container 99 can be manufactured as follows.

In a vacuum chamber of which the degree of vacuum is maintained to $1.0\times10^{-5}$ Pa, the frame member 31 is arranged between the front substrate 1 on which the phosphor and the metal back have been provided and the rear substrate 2 on which the electron-emitting devices and the wirings have been provided. Incidentally, the bonding member 32 consisting of indium is previously provided between the frame member 31 and each of the front substrate 1 and the rear substrate 2. Further, the plate spacers 4 are previously fixed respectively to the scanning wirings on the rear substrate 2.

Subsequently, a laser beam is locally irradiated to the bonding member 32 so that the bonding member is melted. Then, in such a state, the front substrate 1 is pressed toward the rear substrate 2, and then the melted bonding member 32 is cooled down. Thus, the front substrate 1 and the rear substrate 2 are bonded together through the frame member 31, whereby the flat and rectangular airtight container 99 is manufactured. Further, the degree of vacuum of the internal space 98 is maintained to 1.0×10−5 Pa. Consequently, the difference P between the internal pressure and the external pressure of the airtight container 99, used in condition 2, is about 101 kPa (≅101300 Pa−$1.0\times10^{-5}$ Pa).

The longitudinal direction of each of the plural thin plate spacers 4 is the same as the longitudinal direction (i.e., the X direction) of the airtight container 99. The interval L between the adjacent thin plate spacers 4 is 19 mm in the direction (i.e., the Y direction) perpendicular to the longitudinal direction of the airtight container 99. The spacers are provided respectively on the scanning wirings, and the both ends of the spacer in its longitudinal direction are fixed to the rear substrate 2 by means of an inorganic adhesive (e.g., Aron Ceramic D manufactured by Toagosei Co., Ltd).

In this example, the height $H_2$ of the edge of the frame 3 on the side of the internal space 98 is set to be higher than the average height $H_1$ of the spacers 4 by 20 μm. That is, $(H_2-H_1)$ is 20 μm.

Further, the height $H_3$ of the edge of the frame 3 on the side of the atmosphere is set to be higher than the height $H_2$ of the edge of the frame 3 on the side of the internal space 98 by 30 μm. That is, $(H_3-H_2)$ is 30 μm.

Furthermore, the dispersion $\Delta H_1$ of the heights of the spacers 4 is 4 μm.

Consequently, in the airtight container 99 of this example, $1.3(H_2-H_1)/L$ is $1.4\times10^{-3}$ (dimensionless), and $(H_3-H_2)/W$ is $5.0\times10^{-3}$. Thus, the airtight container 99 satisfies condition 1. However, $1.1PL^3/Et^3$ in condition 2 is $1.7\times10^{-3}$, whereby the airtight container 99 in this example does not satisfy condition 2. Further, $3(H_2-H_1)/L$ in condition 3 is $3.2\times10^{-3}$, and $3.5(\Delta H_1/L)$ in condition 3 is $0.7\times10^{-3}$. Thus, the airtight container 99 in this example does not satisfy also condition 3.

However, since the airtight container in this example satisfies condition 1, the proper warped shape is given to each of the front substrate 1 and the rear substrate 2, whereby it is possible to reduce the stress generated, at the position immediately above the frame 3, on the surface G1 of the glass substrate on the side of the atmosphere to be lower than that in the ordinary state.

Further, the airtight container 99 in this example is set to satisfy $H_1<H_2<H_3$ and also satisfy $5(H_2-H_1)/L<(H_3-H_2)/W$, on the X-direction section. By doing so, it is possible to reduce also the stress generated on the surface G1 on the X-direction section. More specifically, the value of $H_3$ on the X-direction section is set to be larger than the value of $H_3$ on the Y-direction section so that $H_3-H_2$ on the X-direction section becomes 35 μm.

Example 2

This example is different from the example 1 only in the point that the airtight container satisfies condition 2 in addition to condition 1.

More specifically, in this example, $(H_2-H_1)$ is 4 μm, and $(H_3-H_2)$ is 11 μm. Namely, other points in this example are the same as those in the example 1.

For this reason, the airtight container 99 in this example satisfies condition 2 in addition to condition 1.

Example 3

This example is different from the example 2 only in the point that the airtight container satisfies condition 3 in addition to condition 1 and condition 2.

More specifically, in this example, $(H_2-H_1)$ is 12 μm, and $(H_3-H_2)$ is 10 μm. Namely, other points in this example are the same as those in the example 2.

For this reason, the airtight container 99 in this example satisfies condition 3 in addition to condition 1 and condition 2.

Incidentally, a strength test for confirming destruction/non-destruction by giving the dropping shock under the same condition was performed to each of the image displaying apparatuses respectively having the airtight containers in the above examples 1 to 3. As a result, with respect to the image displaying apparatus having the airtight container of the ordinary state having the section as illustrated in FIG. 2B, 25 samples, among 100 samples, were destroyed at the portions in the vicinity of the frame 3. Incidentally, the airtight container of the ordinary state implies the airtight container in the example 1 except that all of $H_1$, $H_2$ and $H_3$ in the example 1 were set to 1.6 mm. On the other hand, with respect to the image displaying apparatus having the airtight container in the example 1, any sample, among 100 samples, was not destroyed. However, in the partial samples, when the images were displayed for a long time, deterioration of the displayed images occurred. Also, with respect to the image displaying apparatus having the airtight container in the example 2, any sample, among 100 samples, was not destroyed. In this case, in the partial samples, when the images were displayed for the time same as that in the case where the image displaying apparatus having the airtight container in the example 1 was used, deterioration of the displayed images occurred, but this deterioration was suppressed as compared with the deterioration in the case where the image displaying apparatus having the airtight container in the example 1 was used. That is, it is conceivable that the deterioration of the displayed image occurred when the metal back was partially exfoliated because this metal back being in contact with the spacer 4 was loaded. Further, with respect to the image displaying apparatus having the airtight container in the example 3, any sample, among 100 samples, was not destroyed. Moreover, even when the images were displayed for the time same as that in the case where the image displaying apparatus having the airtight container in the example 1 was used, such deterioration of the displayed images as in the case where the image displaying apparatus having the airtight container in the example 1 or 2 was used did not occur.

As just described, in the above examples, the stress due to the difference between the internal pressure and the external pressure of the airtight container was reduced. Thus, it is possible to reduce the total of the stress generated when the dropping shock is given to the airtight container.

Other Embodiments

Aspects of the present invention can also be realized by a computer of a system or an apparatus (or a device such as a CPU or an MPU) that reads out and executes a program recorded on a memory device to perform the functions of the above-described embodiment, and by a method, the steps of which are performed by a computer of a system or an apparatus by, for example, reading out and executing a program recorded on a memory device to perform the functions of the above-described embodiment. For this purpose, the program is provided to the computer for example via a network or from a recording medium of various types serving as the memory device (e.g., computer-readable medium).

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-175388, filed Jul. 28, 2009, which is hereby incorporated by reference herein in its entirety.

What is claimed is:

1. An airtight container, comprising:

a front substrate;

a rear substrate opposite to the front substrate;

a plurality of spacers arranged between the front substrate and the rear substrate with the spacers having a predetermined interval therebetween; and a frame provided between the front substrate and the rear substrate and surrounding the plurality of spacers, and of which an internal space surrounded by the front substrate, the rear substrate and the frame is maintained at pressure lower than atmospheric pressure, wherein both the front substrate and the rear substrate are made from glass material, the airtight container satisfies $H_1<H_2<H_3$, and $1.3(H_2-H_1)/L<(H_3-H_2)/W$, where $H_1$ is an average height of the spacers, $H_2$ is a height of an edge of the frame on a side of the internal space, $H_3$ is a height of an edge of the frame on a side opposite to the internal space, W is a width of the frame, and L is the predetermined interval.

2. The airtight container according to claim 1, wherein the airtight container satisfies $(H_3-H_2)/W<1.3(H_2-H_1)/L+1.1\times1.01\times10^6\times L^3/Et^3$, where E is a Young's modulus of each of the front substrate and the rear substrate, and t is a thickness of each of the front substrate and the rear substrate.

3. The airtight container according to claim 1, wherein the airtight container satisfies $(H_3-H_2)/W<3(H_2-H_1)/L+3.5\Delta H_1/L$, where $\Delta H_1$ is a dispersion of the heights of the plurality of spacers.

4. The airtight container according to claim 1, wherein the plurality of spacers are plural plate spacers of which respective longitudinal directions are the same direction, the plurality of spacers are arranged in a direction perpendicular to the longitudinal direction, L is equivalent to the interval between two spacers adjacent to each other in the direction perpendicular to the longitudinal direction and is equivalent to the distance between a spacer positioned at both ends in the direction perpendicular to the longitudinal direction and the edge of the frame on the side of the internal space, the edge extending along the longitudinal direction of the plate spacers, and $H_2$ is equivalent to the height of the edge of the frame on the side of the internal space, the edge extending along the longitudinal direction of the plate spacers.

5. An image displaying apparatus which includes at least an airtight container and plural image forming devices provided within the airtight container, wherein the airtight container is the airtight container described in claim 1.

6. A television apparatus which includes an image displaying apparatus, wherein the image displaying apparatus is the image displaying apparatus described in claim 5.

7. The airtight container according to claim 1, wherein a number of plurality of spacers is five or more.

8. The airtight container according to claim 4, wherein the frame has a pair of X-direction edges and a pair of Y-direction edges, the X-direction edges extending along a common longitudinal direction of the plural plate spacers and the Y-direction edges are perpendicular to the common longitudinal direction and, the airtight container satisfies $H_1<H_{V2}<H_{V3}$, and $5(H_{V2}-H_{V1})/L<(H_{V3}-H_{V2})/W_V$, where $H_1$ is an average height of the spacers, $H_{V2}$ is a height of a Y-direction edge of the frame on a side of the internal space, $H_{V3}$ is a height of a Y-direction edge of the frame on a side opposite to the internal space, $W_V$ is a width of a Y-direction edge of the frame, and L is the predetermined interval.

9. The airtight container according to claim 1, wherein the difference $(H_2-H_1)$ is 4 μm or more and 30 μm or less.

10. The airtight container according to claim 1, wherein the value $\{(H_3-H_2)/W\}$ is 0.5 μm/mm or more and 2.5 μm/mm or less.

11. The airtight container according to claim 3, wherein the airtight container satisfies $(H_3-H_2)/W<3(H_2-H_1)/L+3.5\Delta H_1/L$, a bonding member is positioned between the frame and at least one of the front substrate and the rear substrate and, a section shape obtained by integrating the frame and the bonding member is substantially trapezoid, where $\Delta H_1$ is a dispersion of the heights of the plurality of spacers.

12. The airtight container according to claim 2, wherein the airtight container satisfies $(H_3-H_2)/W<3(H_2-H_1)/L+3.5\Delta H_1/L$, an edge member is positioned adjacent the frame and defines the distance between the front substrate and the rear substrate, a section shape obtained by combining the frame and the edge member is substantially trapezoid, and where $\Delta H_1$ is a dispersion of the heights of the plurality of spacers.

* * * * *